US005338023A

United States Patent [19]

Stovall

[11] Patent Number: 5,338,023

[45] Date of Patent: Aug. 16, 1994

[54] REMOVABLE PORTABLE BASKETBALL NET

[75] Inventor: Daryl R. Stovall, Omaha, Nebr.

[73] Assignee: Creighton University Office of Technology Licensing, Omaha, Nebr.

[21] Appl. No.: 72,793

[22] Filed: Jun. 4, 1993

[51] Int. Cl.[5] ..... A63B 63/08

[52] U.S. Cl. ..... 273/15 R

[58] Field of Search ..... 273/1.5 R, 1.5 A

[56] References Cited

U.S. PATENT DOCUMENTS

| | | | |
|---|---|---|---|
| 1,544,453 | 6/1925 | Harbison | 273/1.5 R |
| 2,199,609 | 5/1940 | Bennett | 273/1.5 R |
| 4,082,269 | 4/1978 | Hill | 273/1.5 R |
| 4,805,903 | 2/1989 | McArdle | 273/1.5 R |
| 4,903,964 | 2/1990 | Anderson | 273/1.5 R |
| 5,098,091 | 3/1992 | McGivern | 273/1.5 R |
| 5,123,642 | 6/1992 | Stokes | 273/1.5 R |

*Primary Examiner*—Paul E. Shapiro

*Attorney, Agent, or Firm*—Sean Patrick Suiter

[57] ABSTRACT

A method of removably securing a basketball net to a basketball basket ring wherein an attachment clip is provided at each loop of a conventional basketball net for securing the net to a conventional basketball basket ring. An installation disk, having substantially the same diameter as a basket ring is provided to spread the attachment clip end of the clip and net combination to the diameter of the basket ring such that the clips may be easily secured to the ring. An apparatus for practicing the before described method is also disclosed.

3 Claims, 5 Drawing Sheets

REMOVABLE PORTABLE BASKETBALL NET

TECHNICAL FIELD

The present invention is generally related to sporting equipment and more specifically to the "basket" or goal utilized in the sport of basketball.

BACKGROUND ART

Organized basketball is most commonly played in school, club, or community gymnasiums. However, "pick-up games" are commonly played by loosely organized school or neighborhood groups on playgrounds, driveways, patios, and the like. In organized versions of play each team each teams tries to score "baskets" (field goals) by shooting a ball into a raised basketlike goal. The general object of the game is to cause the ball to pass through the "basket" or goal more times than the opposing team.

The "basket" or goal consists of an elevated metal ring mounted to a backboard. In organized play, a cylindrical white cord net is attached to the basket ring such that a ball passing through the basket ring is guided and slowed by the net. In this manner, the net provides shot and rebound continuity in that the action of the ball, after leaving the net, may be reasonably predicted as a result of the action of the net on the ball. Therefore, the net contributes to the fast pace of the game in that the net reduces the number of play interruptions wherein ball possession must be determined and/or the ball must be placed back in play.

Unfortunately, in unorganized or loosely organized games played informally on asphalt or concrete playground courts and the like, the net is missing. This slows play and otherwise changes playing characteristics. Because the absence of a net is most commonly caused by theft, some parties have installed nets made of metal chains. These metal nets, however, are expensive and also change ball play characteristics.

Therefore it is a principle object of the present invention to provide an improved basketball net apparatus.

Another object of the present invention is to provide an improved method of removably installing a basketball net to a basketball ring.

Another object of the present invention is to provide an improved basketball net apparatus which is durable in construction, easy to use, and dependable.

Another object of the present invention is to provide an improved basketball net apparatus which does not adversely change ball shooting and rebounding characteristics.

Another object of the present invention is to provide an improved basketball net apparatus which is easy to manufacture.

Finally, another object of the present invention is to provide an improved basketball net method and apparatus that allows loosely organized playground play to more closely approximate an organized basketball competition.

DISCLOSURE OF THE INVENTION

The apparatus of the present invention, in its most basic form, includes a conventional white cord basketball net, an installation disk having a diameter substantially equal to the diameter of the basket ring of a basketball basket, and an attachment clip secured to each of the net's twelve connecting loops for removably attaching the net to a basketball basket ring.

The method of the present invention includes the steps of spreading the net to the diameter of the basketball basket ring via the installation disk and then removably securing each of the attachment clips to the basketball basket ring, and removing the installation disk such that the net is removably secured to the ring and forms a basket having play characteristics substantially similar to those of conventional nets. Conventional nets are those which are designed to be removed (with the net intact and useable) only with great difficulty.

BRIEF DESCRIPTION OF THE DRAWINGS

Other objects and advantages of the invention will become apparent upon reading the following detailed description and upon reference to the drawings, in which:

FIGS. 5A through 10A are partial cross sectional views illustrating various exemplary attachment clips removably securing the net to a basket ring;

FIGS. 5B through 10B are perspective views of various exemplary attachment clips for removably securing a net to a basket ring according to the method and apparatus of the present invention.

While the invention will be described in connection with a preferred embodiment, it will be understood that it is not intended to limit the invention to such an embodiment. On the contrary, it is intended to cover all alternatives modifications and equivalents as may be included within the spirit and scope of the invention as defined by the appended claims.

BEST MODE FOR CARRYING OUT THE INVENTION

Figure 1:
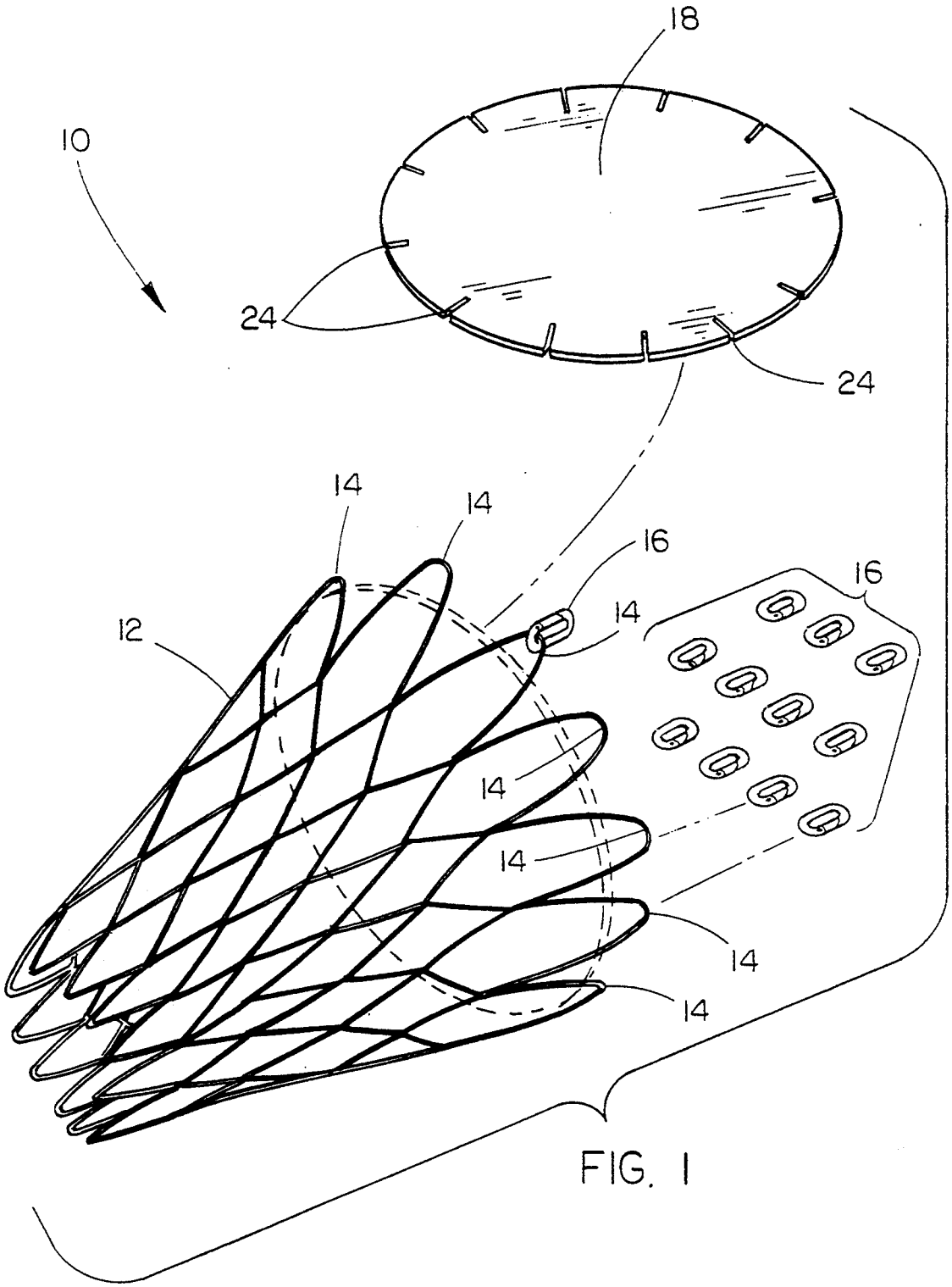
FIG. 1 is a perspective exploded view of the components of the present invention wherein the net, exemplary attachment means, and installation disk are illustrated.

Turning first to FIG. 1, wherein the components of an exemplary embodiment of the apparatus of the present invention 10 are illustrated, it may be seen that a conventional basketball net 12 (fabricated from a natural or synthetic cord material), having twelve attachment loops 14, may be modified according to the present invention. While a shorter net may be utilized, in accordance with the invention hereof, in order to subtract the additional length of any particular attachment clip (fastener) 16, a conventional net may be utilized without adverse results.

Figure 2:
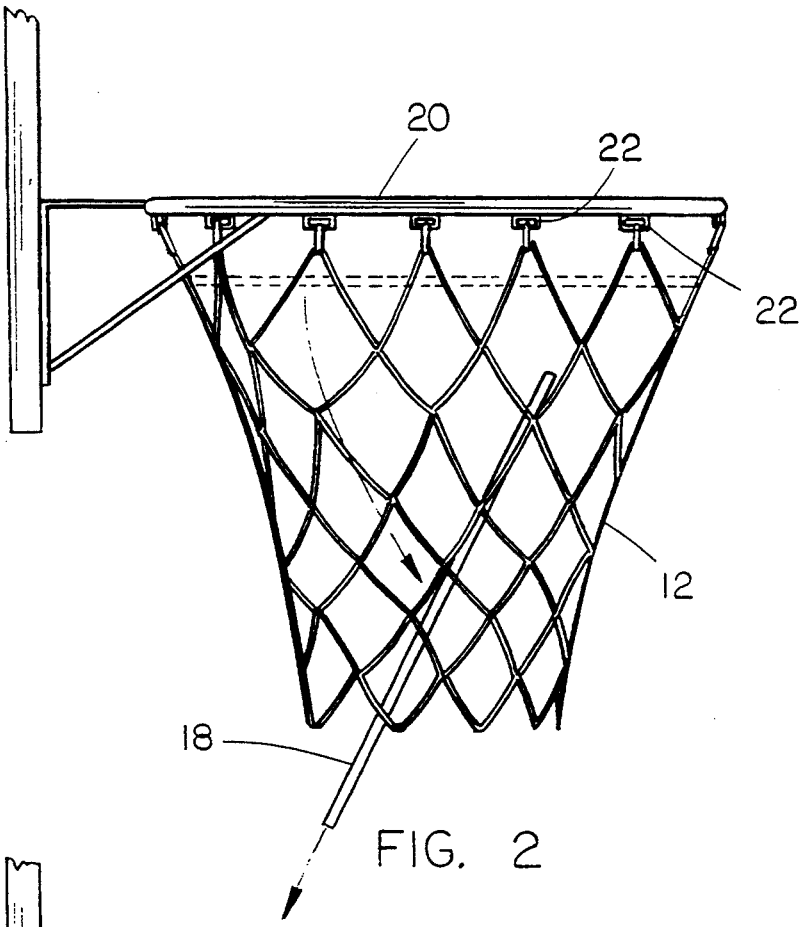
FIGS. 2, 3, and 4 are perspective views of the present invention illustrating the use of the installation disk to facilitate the method of removably securing the net via the attachment clips to a basket ring with the installation ring.
Figure 3:
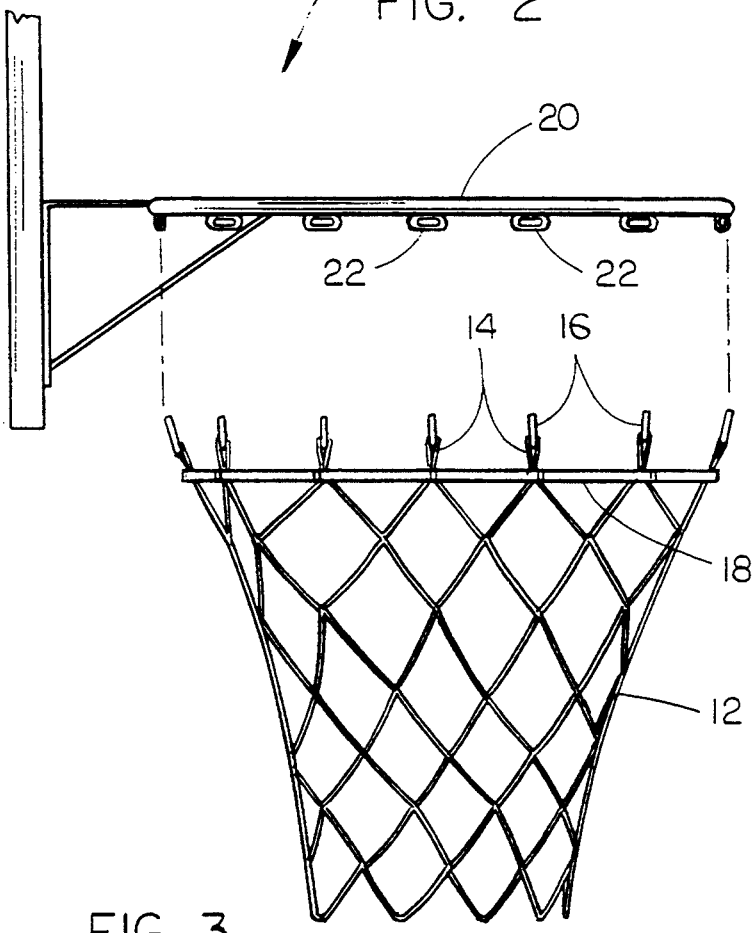
Figure 4:
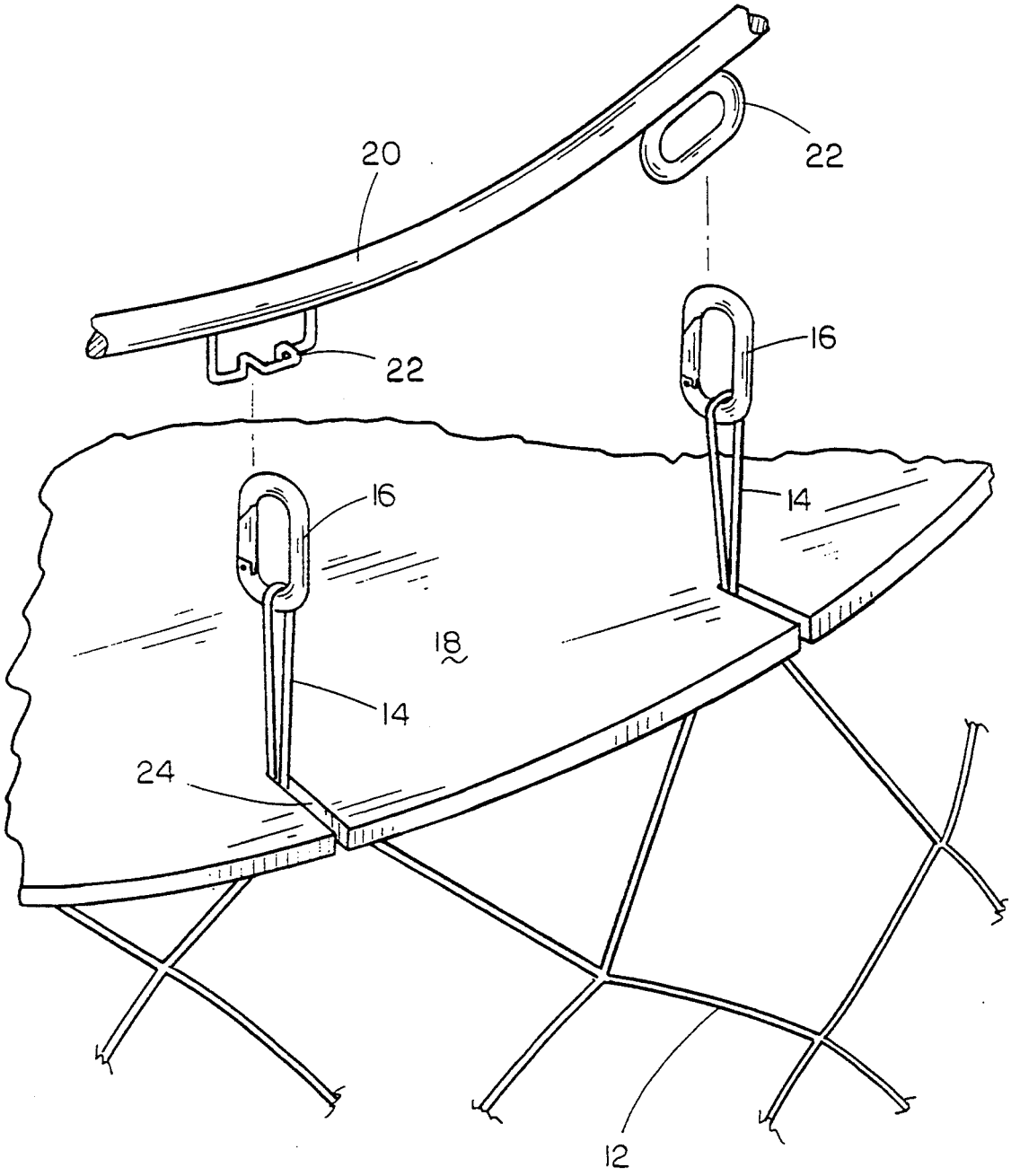
Figure 10A:
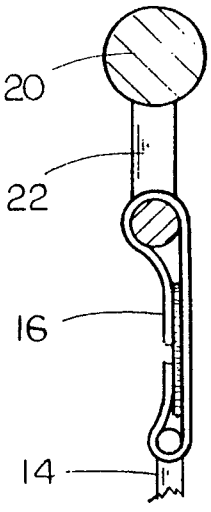
Figure 10B:
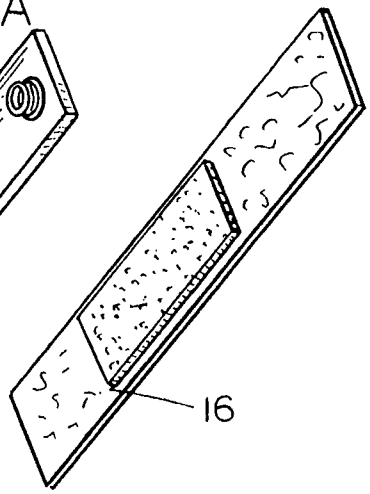
Figure 9A:
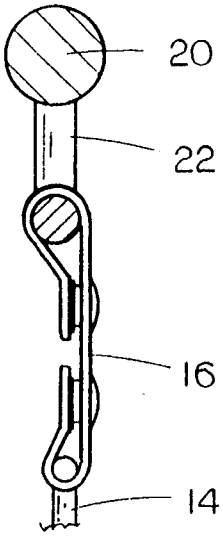
Figure 9B:
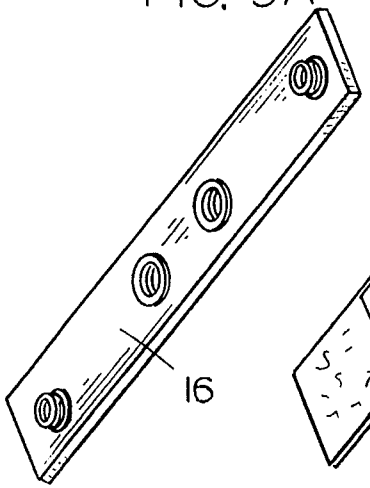
Figure 8A:
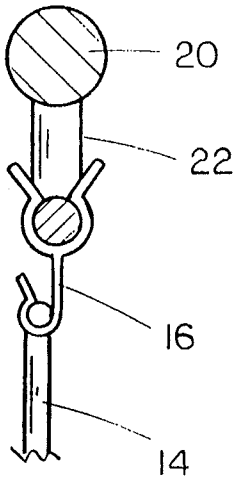
Figure 8B:
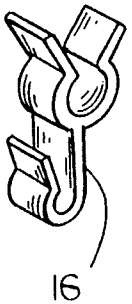
Figure 7A:
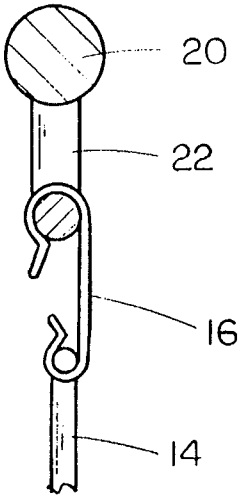
Figure 7B:
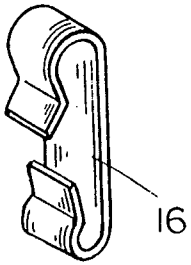
Figure 6A:
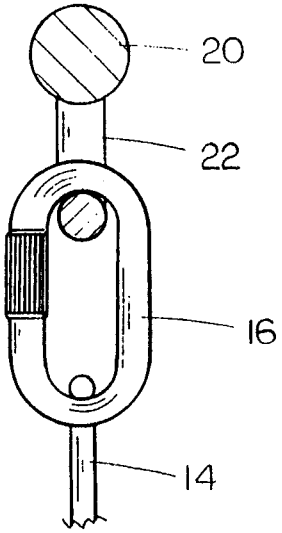
Figure 6B:
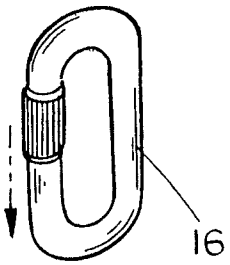
Figure 5A:
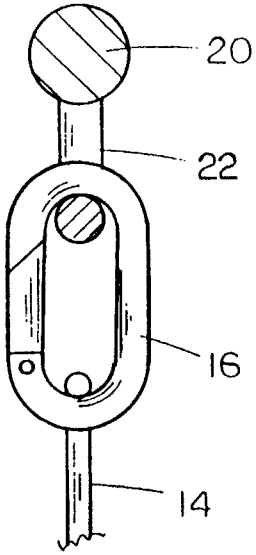
Figure 5B:
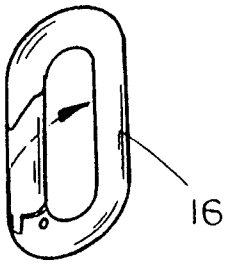
Figure 11:
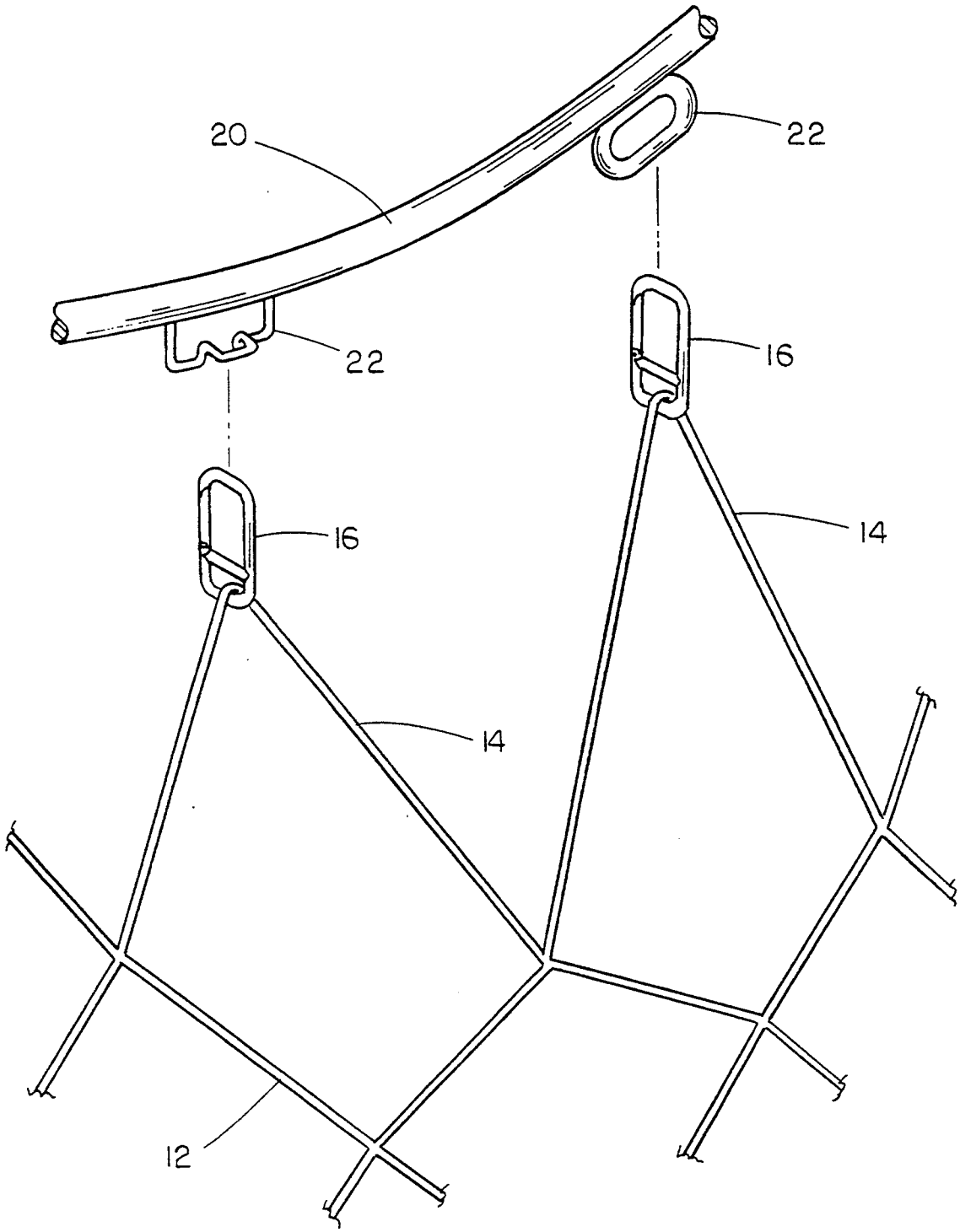
FIG. 11 is a partial perspective view of the present invention wherein an additional exemplary attachment clip is shown and wherein two different basket ring attachment points are illustrated.

A fastener 16 of any acceptable and workable type, such as one of any of the variety illustrated herein in FIGS. 5–11 as elements 16–16$^{111111}$ respectively, may be secured to each attachment loop 14 of the net 12. An installation disk 18, preferably having a diameter of 46 centimeters (or approximately equal to the 46 centimeter diameter of the basket ring 20), is also provided for expanding or spreading the net 12 into a circular cross section at the net attachment end such that the fasteners 16 may be easily secured to the net ring attachment areas 20 of a conventional basketball basket ring 20 (FIGS. 1–3). The installation disk 18 may then be unsecured from the net 12 and removed for play (FIGS. 1–4).

In order to remove the apparatus 10 from a basket ring 18, the installation disk may be reinserted into the position shown in FIG. 2 (dashed lines). Each of the twelve fasteners 16 may then be unsecured from the basket ring 20 such that the net may be removed (FIG. 3) and stored for later use.

While the invention has been described with a certain degree of particularity, it is manifest that many changes may be made in the details and arrangement of components without departing from the spirit and scope of the disclosure. It is understood that the invention is not limited to the embodiments set forth herein for purposes of exemplification, but is to be limited only by the scope of the appended claims including the full range of equivalency to which each element thereof is entitled.

Thus, there has been shown and described a removable portable basketball net which accomplishes at least all of the stated objects.

I claim:

1. An apparatus for removably securing a basketball net to a basketball basket ring, comprising:

(a) an attachment clip secured to each attachment loop of a basketball net for securing said net to a conventional basketball basket ring; and (b) an installation disk having substantially the same diameter as a conventional basketball basket ring for spreading said attachment clips to the diameter of said basket ring such that said clips secured to the perimeter of said installation disk may be removably secured about the perimeter of said basketball basket ring such that said net hangs from said ring substantially similar to a conventional net.

2. The apparatus for removably securing a basketball net to a basketball basket ring of claim 1, further comprising removable securement means for removably securing said net to said installation disk.

3. The apparatus for removably securing a basketball net to a basketball basket ring of claim 2, wherein said removable securement means is a plurality of slots formed around the perimeter of said installation disk.

* * * * *